US005579961A

United States Patent [19]

Zimmerman

[11] Patent Number: 5,579,961

[45] Date of Patent: Dec. 3, 1996

[54] CONTAINER TOP INCLUDING COVER WITH ROTATABLE MEMBER

[75] Inventor: Larry G. Zimmerman, Hollis, N.H.

[73] Assignee: Sterilite Corporation, Townsend, Mass.

[21] Appl. No.: 511,147

[22] Filed: Aug. 4, 1995

[51] Int. Cl.[6] ..... B65D 47/00

[52] U.S. Cl. ..... 222/545; 222/556

[58] Field of Search ..... 222/498, 545, 222/556, 558

[56] References Cited

U.S. PATENT DOCUMENTS

| | | | |
|---|---|---|---|
| 4,558,806 | 12/1985 | Shabram, Sr. et al. | 222/498 |
| 4,887,747 | 12/1989 | Ostrowsky et al. | 222/556 |
| 5,271,536 | 12/1993 | Wilson | 222/556 X |

OTHER PUBLICATIONS

Tupperware: creamer, sugar, salt & pepper; press down on one side, pops up to open; 1 page.
Tupperware: (4) Tabletop Line; (22) Pitchers and Tumblers; 1 page.
Tupperware pitcher; press down one side, opposite side pops up to open. 1994; 1 page.
Tupperware 1–Qt and 2–Qt pitchers; 1 page.
Tupperware; pitcher with container top; 1 page.
Sterilite: No. 450 1 Gal. pitcher; press down on one side, opposite side pops up to open; 1 page.
Sterilite: #460 2½ Quart Pitcher; press down on one side, opposite pops up; 1 page.
Rubbermaid; Servin'Saver; Dry Food Storage; No. 3902 and 3905; 1 page.
Rubbermaid; Servin'Saver; Beverageware; 1 page.
Eagle/Superseal; Beverage Ware; 1 page.
Anchor; Pitcher; 1 page.
Space Saver Servers by Alladinware; 1 page.
Giant Server with new Easy–Pour Spout from Alladinware; 1 page.
The Continental Shaker Pitcher by Alladinware; 1 page.
Davis; Pitchers with container tops; 1 page.
Tucker 1 Gallon and 2 Quart Decanters; 1 page.
Tucker: Decanters with container tops; 1 page.
Küche: Curver; pitchers with container tops; 1 page.
1,500 Pitcher: Tonbo Plastics 1992 Japan catalog; p. 29.
Handle on mug for Chill Out! ad; 1 page.
Handle on thermos #29 white (32 US fl. Oz/1 liter); 1 page.
Rounded Cap for Thermos ® Coffee Butler®+00 Carafe #300W White; 1 page.

*Primary Examiner*—Gregory L. Huson
*Attorney, Agent, or Firm*—Ernest V. Linek

[57] ABSTRACT

A container top including cover with rotatable member, the rotatable member supporting a sealing member for the opening in the cover, the cover having camming member for engaging said rotatable member as the rotatable member is rotated from a sealing to an open position.

1 Claim, 2 Drawing Sheets

CONTAINER TOP INCLUDING COVER WITH ROTATABLE MEMBER

BACKGROUND OF THE INVENTION

This invention is directed to a new and improved plastic container which is used to pour liquid.

Plastic containers having removable tops for storing and pouring liquids e.g. juice are well known.

They come in various forms and have an opening for the liquid and sometimes a spout to direct the flow of liquid from the container.

Very often the port (opening) is provided with a cap which takes various forms to seal the port.

This invention provides a plastic top for a container which has a new and improved sealing means as well as new and improved means to make it easy to use.

BRIEF DESCRIPTION OF THE INVENTION

The top of this invention is in two parts, namely a first fixed member adapted to be positioned on top of a container and which has a port for liquid to be poured out of the container. Preferably a spout is connected to the port for direct liquid flow from the container.

In addition, the fixed member includes a support for a flexible rotatable member and a well formed in the first part to permit limited rotation of the rotatable member. The fixed member also has camming surface supported on a curved vertical wall of the well. The rotatable member includes a sealing member for the port. The rotatable member is adapted to partially rotate into the well over the camming surface which then prevents the sealing member from moving in a direction to reseal the port.

DETAILED DESCRIPTION OF THE INVENTION

Figure 1:
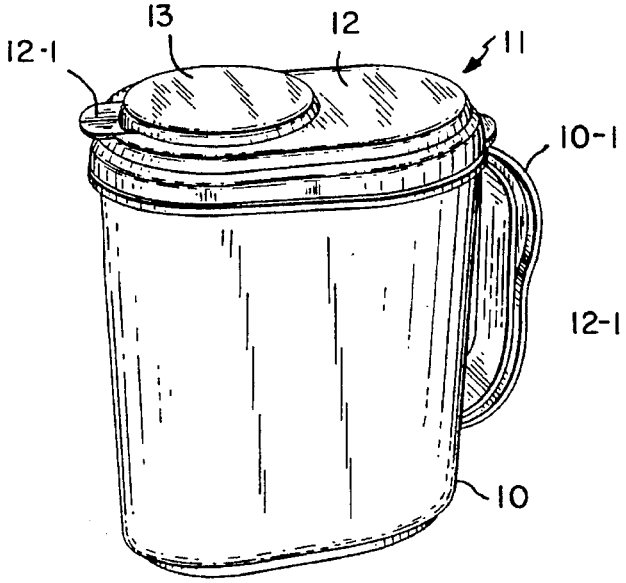
FIG. 1 shows a perspective view of a container and the top of this invention supported over the outer edge of a container.

Reference should now be had to FIGS. 1 to 7 for a description of the preferred embodiment.

At 11 there is shown a container preferably of plastic having a handle 10-1.

Liquids such as juice is placed in the container 11.

The container 10 is provided with the new and improved plastic top 11 of this invention which includes a cover 12.

The cover 12 includes a spout 12-1 for directing the liquid out of the container. Coupled to the top cover 12 is a cap 13 (rotatable member) mounted for rotation to the top 12.

The top cover 12 (fixed member) has an opening defined by a tubular wall 12-8 through which the liquid in the container 11 flows before being directed outwardly by the spout 12-1.

The cover 12 also includes a recess (well) 12-10 defined by a lower depressed wall 12-2 and a curved back (vertical) wall 12-3. A cam member 12-4 projects from the curved vertical wall 12-3.

The tubular wall 12-8 has an inwardly projecting portion 12-19 which cooperates with a portion of the cap 13-2 having a projection portion 13-3 to seal the liquid in the container 11 from the outside air and etc.

The top includes cap (rotatable member) which has projecting pins 13-5 which snap into recesses 12-7 in the cover 12 and are guided therein by vertical recesses 12-8 in the recess sidewall 12-10.

Figure 2:
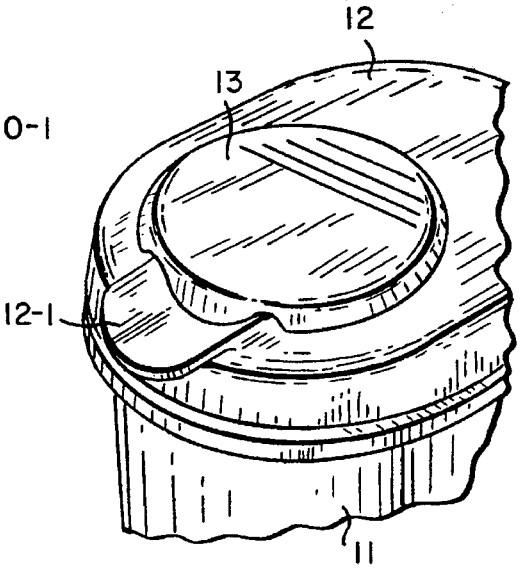
FIG. 2 is an enlarged partial perspective view of the top and the container with the rotatable member thereof in a sealing position.
Figure 3:
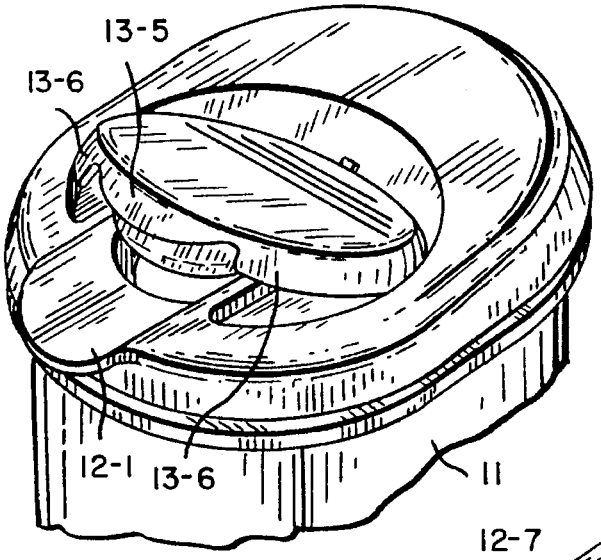
FIG. 3 is a view similar to FIG. 2 with the rotatable member in an open position.
Figure 4:
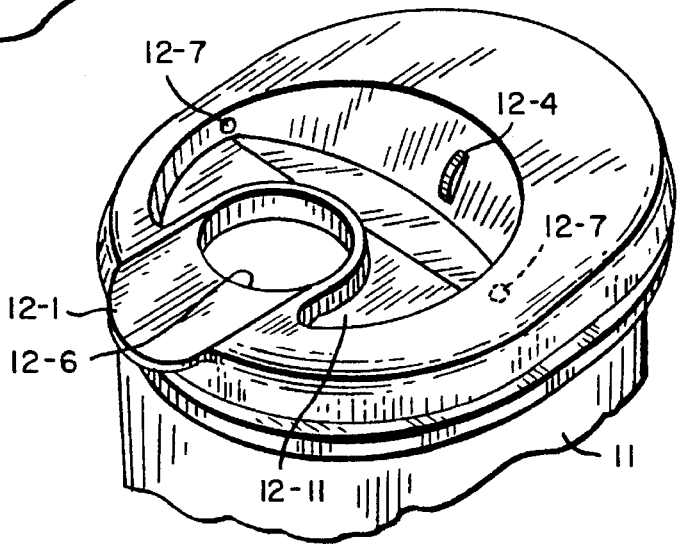
FIG. 4 is a view of the top similar to FIG. 2 with the rotatable member of the top removed.
Figure 5:
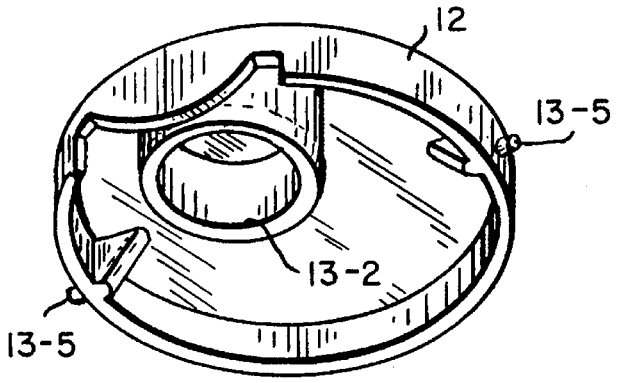
FIG. 5 is a perspective view showing the bottom of the rotatable member.
Figure 6:
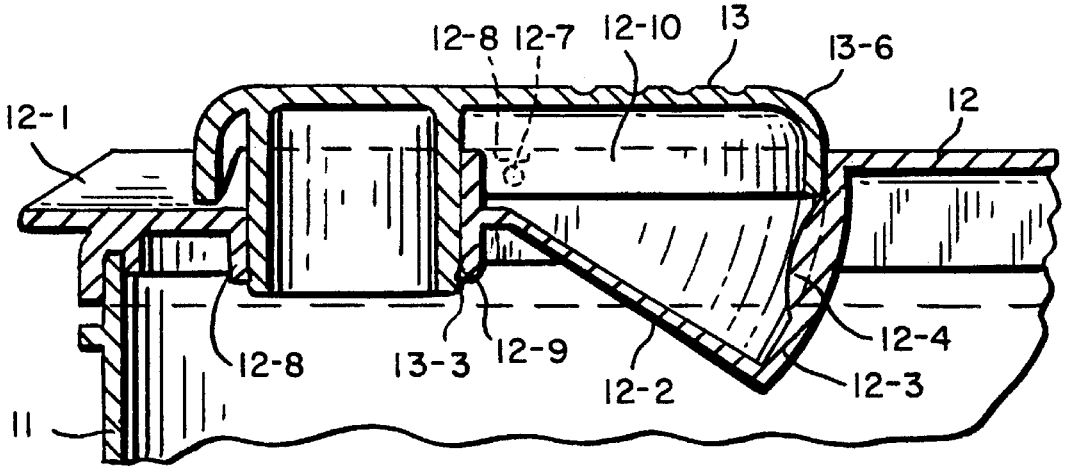
FIG. 6 is a partial sectional view taken along 6—6 of FIG. 2.
Figure 7:
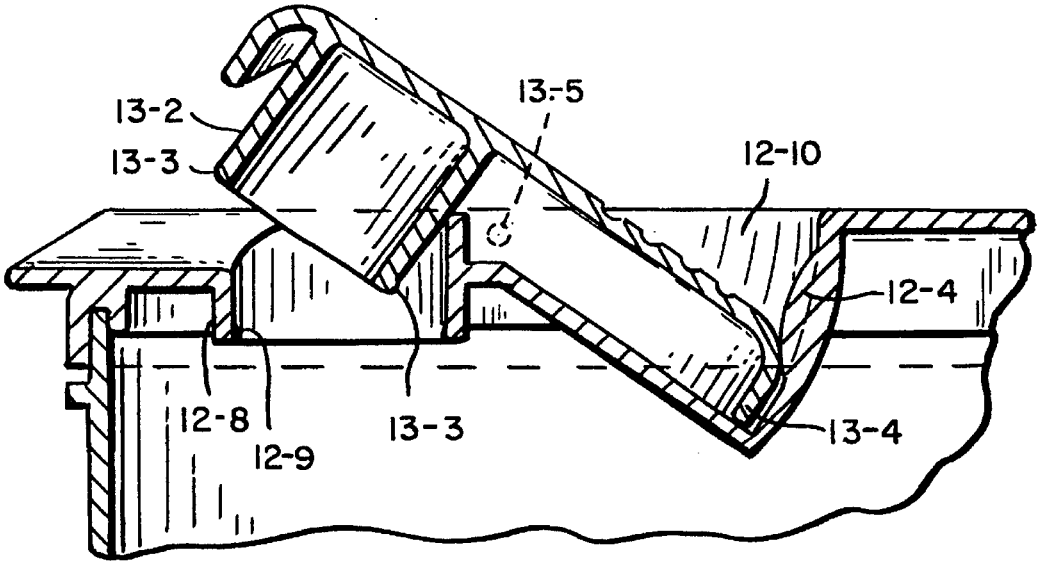
FIG. 7 is a sectional view taken along line 7—7 in FIG. 3.

The cap 13 is rotatable between a closed position as shown in FIGS. 2 and 6 to an open position as shown in FIGS. 3 and 7.

In the closed position, the cap has a curved projecting portion 13-5 for sealing the spout 12-1 and a curved lip portion for seating on the recess shelf 12-11 as seen, when in the closed position.

The curved camming surface 12-4 is substantially shaped as a segment of a circle and frictionally engages the rear skirt portion 13-6 of the cap 13. To open top, the cap 13 rear portion 13-8 is depressed to rotate the cap clockwise over the highpoint of the cam (see FIG. 7) so that the cap 13 portion 13-3 snaps by the inwardly facing projection 12-9.

The cap 13 is retained in an open position by the cam 12-4 preventing closure (see FIG. 7).

In order to reseal the cover opening, the cap is depressed at the front portion 13-10 to the position shown in FIG. 6 whereby the projection 13-3 snaps over projection 12-9 to seal the fluid in the container 10.

I claim:

1. A container top including cover member supporting a rotatable member for rotation, said cover member including a port and a spout in communication therewith, the rotatable member including a portion for sealing the spout and a portion for sealing the port, said cover member having a cam member for engaging said rotatable member as the rotatable member is rotated from a sealing to an open position, said cam member preventing said rotatable member from rotating back to a sealing position until forced over the cam member by the user and said cam member preventing rotation of said rotatable member to an open position until forced over the cam member by the user.

* * * * *